US008881521B2

(12) United States Patent
Browne et al.

(10) Patent No.: US 8,881,521 B2
(45) Date of Patent: Nov. 11, 2014

(54) CABLE PROTECTION SYSTEM AND METHOD OF REDUCING AN INITIAL STRESS ON A CABLE

(75) Inventors: Alan L. Browne, Grosse Pointe, MI (US); Paul W. Alexander, Ypsilanti, MI (US); Nancy L. Johnson, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 149 days.

(21) Appl. No.: 13/587,383

(22) Filed: Aug. 16, 2012

(65) Prior Publication Data

US 2012/0324858 A1 Dec. 27, 2012

Related U.S. Application Data

(63) Continuation-in-part of application No. 12/397,482, filed on Mar. 4, 2009, now Pat. No. 8,272,214.

(60) Provisional application No. 61/034,884, filed on Mar. 7, 2008, provisional application No. 61/034,913, filed on Mar. 7, 2008.

(51) Int. Cl.

| | |
|---|---|
| ***F01B 29/10*** | (2006.01) |
| ***F02G 1/04*** | (2006.01) |
| ***D02G 3/02*** | (2006.01) |
| ***D02G 3/36*** | (2006.01) |
| ***E01D 19/16*** | (2006.01) |
| ***D07B 5/12*** | (2006.01) |
| ***D07B 1/06*** | (2006.01) |
| ***D07B 5/00*** | (2006.01) |

(52) U.S. Cl.

CPC *D07B 5/00* (2013.01); *E01D 19/16* (2013.01); *D07B 2201/2009* (2013.01); *D07B 5/12* (2013.01); *D07B 1/0673* (2013.01); *D07B 2205/3085* (2013.01)

USPC ..... 60/527; 60/529; 57/237

(58) Field of Classification Search

USPC ..... 60/527–529

See application file for complete search history.

(56) References Cited

U.S. PATENT DOCUMENTS

| | | | | |
|---|---|---|---|---|
| 2,758,491 A * | 8/1956 | Buchanan | ..... | 72/416 |
| 2005/0150223 A1 * | 7/2005 | Rey et al. | ..... | 60/527 |

* cited by examiner

*Primary Examiner* — Christopher Jetton

(74) *Attorney, Agent, or Firm* — Quinn Law Group, PLLC

(57) ABSTRACT

A method of reducing an initial stress on a cable includes stretching the cable to a first length to thereby define the initial stress. The cable has a central longitudinal axis, and includes a plurality of wires each twisted around the axis and formed from a shape memory alloy transitionable in response to a signal between a first state wherein each of the wires has a first temperature-dependent length, and a second state wherein each of the wires has a second temperature-dependent length that is less than the first. After stretching, the method includes activating the alloy by exposing the alloy to the signal such that the alloy transitions from the first to the second temperature-dependent state. Concurrent to activating, the method includes elongating the cable to a second length that is greater than the first to define a second stress on the cable that is less than the first.

20 Claims, 5 Drawing Sheets

CABLE PROTECTION SYSTEM AND METHOD OF REDUCING AN INITIAL STRESS ON A CABLE

CROSS-REFERENCE TO RELATED APPLICATIONS

This application is a continuation-in-part of U.S. patent application Ser. No. 12/397,482, filed on Mar. 4, 2009, which claims priority to U.S. Patent Application No. 61/034,884, filed on Mar. 7, 2008, and U.S. Patent Application No. 61/034,913, filed on Mar. 7, 2008, which are each hereby incorporated by reference in their entirety.

TECHNICAL FIELD

The disclosure relates to cables, and more specifically, to cable protection systems and methods of reducing an initial stress on a cable.

BACKGROUND

Structural tension cables made of natural and synthetic materials have been developed for a variety of useful applications. For example, cables are used in civil engineering structures for power cables, bridge stays, and mine shafts; in marine and naval structures for salvage/recovery, towing, vessel mooring, yacht rigging, and oil platforms; in aerospace structures for light aircraft control cables and astronaut tethering; and in recreation applications like cable cars and ski lifts. Typically, these cables are composed of steel wires helically wound into strands, which, in turn, are wound around a core.

SUMMARY

A method of reducing an initial stress on a cable includes stretching the cable to a first length in response to a force generated by a load to thereby define the initial stress on the cable. The cable has a central longitudinal axis and includes a plurality of wires each twisted around the central longitudinal axis and formed from a shape memory alloy. The shape memory alloy is transitionable in response to an activation signal between a first temperature-dependent state wherein each of the plurality of wires has a first temperature-dependent length, and a second temperature-dependent state wherein each of the plurality of wires has a second temperature-dependent length that is less than the first temperature-dependent length. After stretching, the method includes activating the shape memory alloy by exposing the shape memory alloy to the activation signal such that the shape memory alloy transitions from the first temperature-dependent state to the second temperature-dependent state. Concurrent to activating, the method includes elongating the cable to a second length that is greater than the first length in response to the force to define a second stress on the cable that is less than the initial stress and thereby reduce the initial stress on the cable.

In one embodiment of the method, the cable includes an inter-wire element longitudinally engaged with and disposed adjacent to the plurality of wires, wherein the inter-wire element is operable to modify interaction between the plurality of wires. Further, the method includes, concurrent to activating, contacting at least one of the plurality of wires and the inter-wire element.

A cable protection system includes a cable having a central longitudinal axis and including a plurality of wires each twisted around the central longitudinal axis and formed from a shape memory alloy. The shape memory alloy is transitionable in response to an activation signal between a first temperature-dependent state wherein each of the plurality of wires has a first temperature-dependent length, and a second temperature-dependent state wherein each of the plurality of wires has a second temperature-dependent length that is less than the first temperature-dependent length. The cable protection system also includes a plurality of rails translatable between a first position wherein each of the plurality of rails is disposed adjacent to and in contact with the cable, and a second position wherein each of the plurality of rails is spaced apart from the cable.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Figure 1:
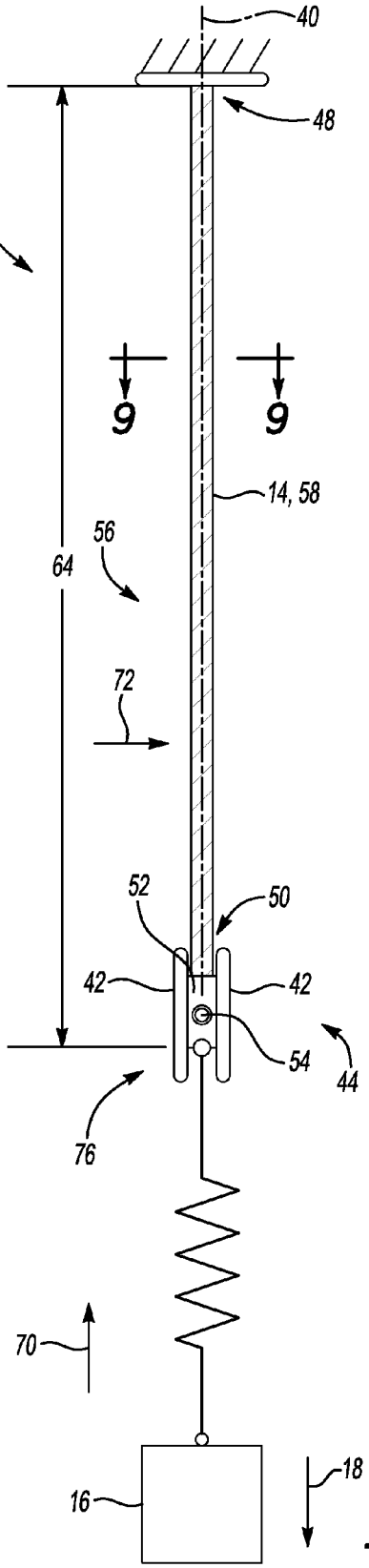
FIG. 1 is a schematic illustration of a cable protection system including a cable and a plurality of rails disposed in a first position.
Figure 2:
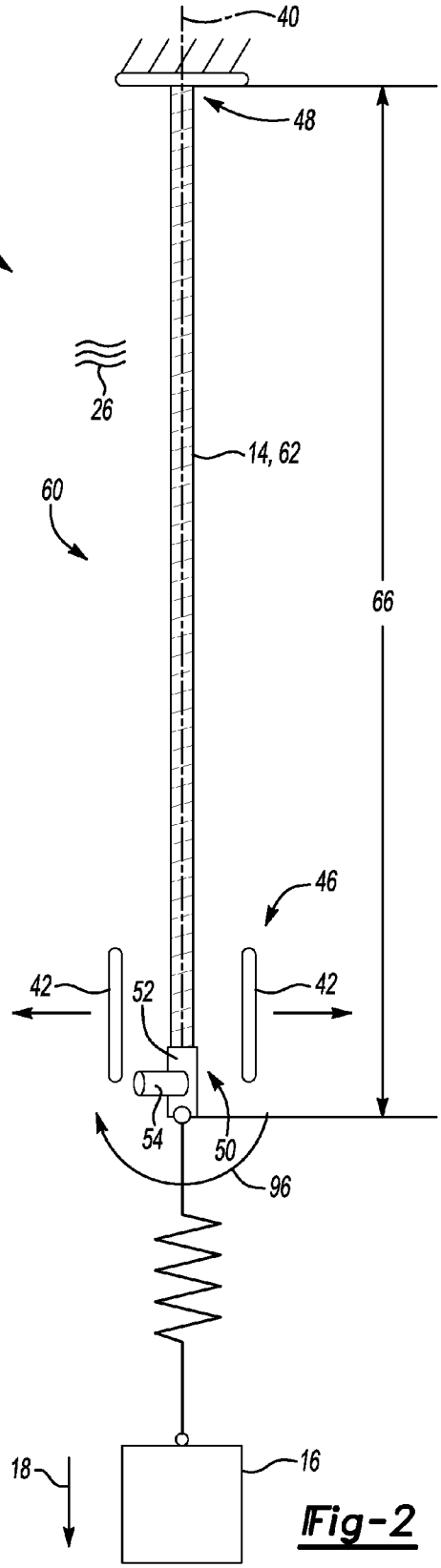
FIG. 2 is a schematic illustration of the cable protection system of FIG. 1 wherein the plurality of rails are disposed in a second position.
Figure 3:
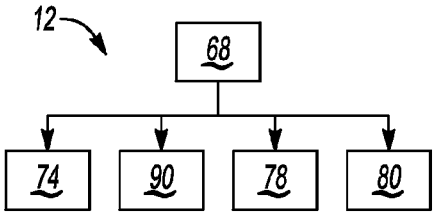
FIG. 3 is a schematic flowchart of a method of reducing an initial stress on the cable of FIGS. 1 and 2.

Referring to the Figures, wherein like reference numerals refer to like elements, a cable protection system 10 is shown generally in FIGS. 1 and 2, and a method 12 of reducing an initial stress 58 (FIG. 1) on a cable 14 (FIGS. 1 and 2) is shown generally in FIG. 3. The cable protection system 10 and method 12 may be useful for applications requiring protection of cables 14 from an overload condition. For example, as set forth in more detail below, under certain circumstances, the cable 14 may require protection from a load 16 (FIG. 1) generating a force (denoted generally by arrow 18 in FIG. 1) in excess of a yield strength of the cable 14. Eventually, without protection of the cable 14 provided by the cable protection system 10 and method 12, such loads 16 may overstress and overstretch the cable 14, and thereby damage the cable 14. For example, such loads 16 may fray, warp, bend, and/or break at least a portion of the cable 14. The cable protection system 10 and method 12 may be useful for automotive applications requiring excellent cable strength and longevity. However, the cable protection system 10 and method 12 may also be useful for non-automotive applications including, but not limited to, marine, aviation, civil engineering, and recreation applications.

Referring again to FIG. 1, the cable protection system 10 includes the cable 14 having a central longitudinal axis 40 and including a plurality of wires 22 (FIG. 8) each twisted around the central longitudinal axis 40. That is, the cable 14 generally includes a plurality of longitudinally engaged and cooperatively functioning wires 22. The cable 14 may be used to lift the load 16 (FIG. 1), and as such may have excellent tensile strength. As used herein, the terminology "cable" encompasses other geometric forms such as, but not limited to, ropes, braids, bundles, and the like.

Figure 8:
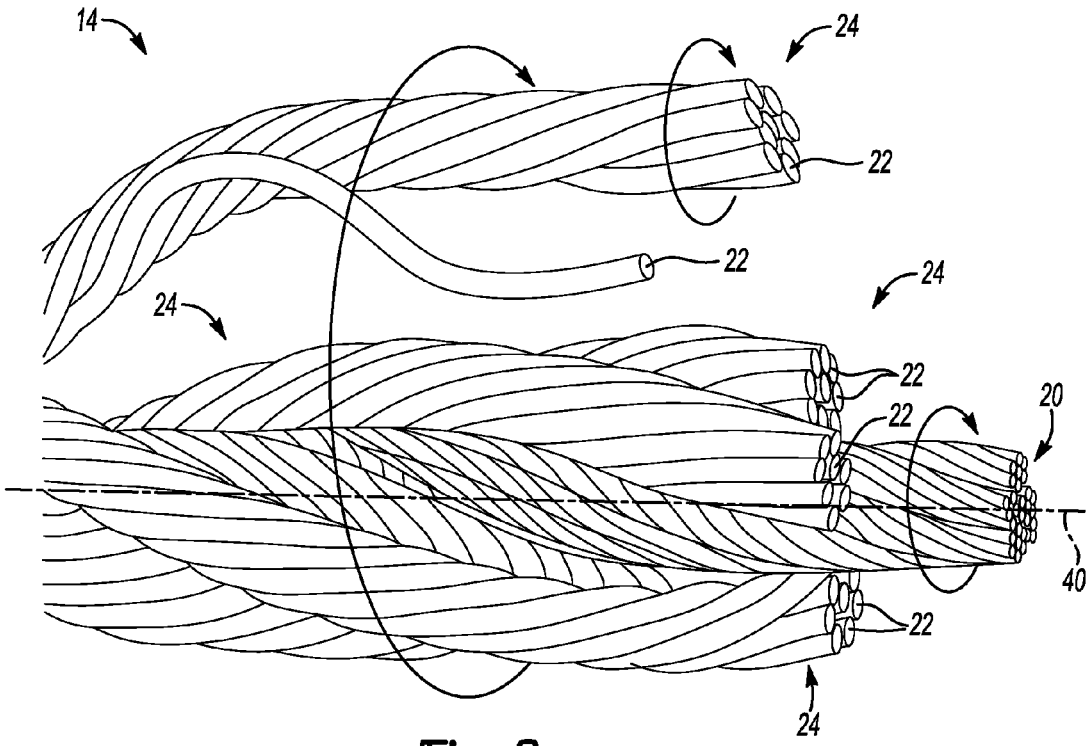
FIG. 8 is a schematic illustration of a perspective view of the cable of FIGS. 1 and 2, wherein the cable is partially untwisted and includes a plurality of wires each formed from a shape memory alloy and twisted about a central longitudinal axis of the cable.
Figure 9:
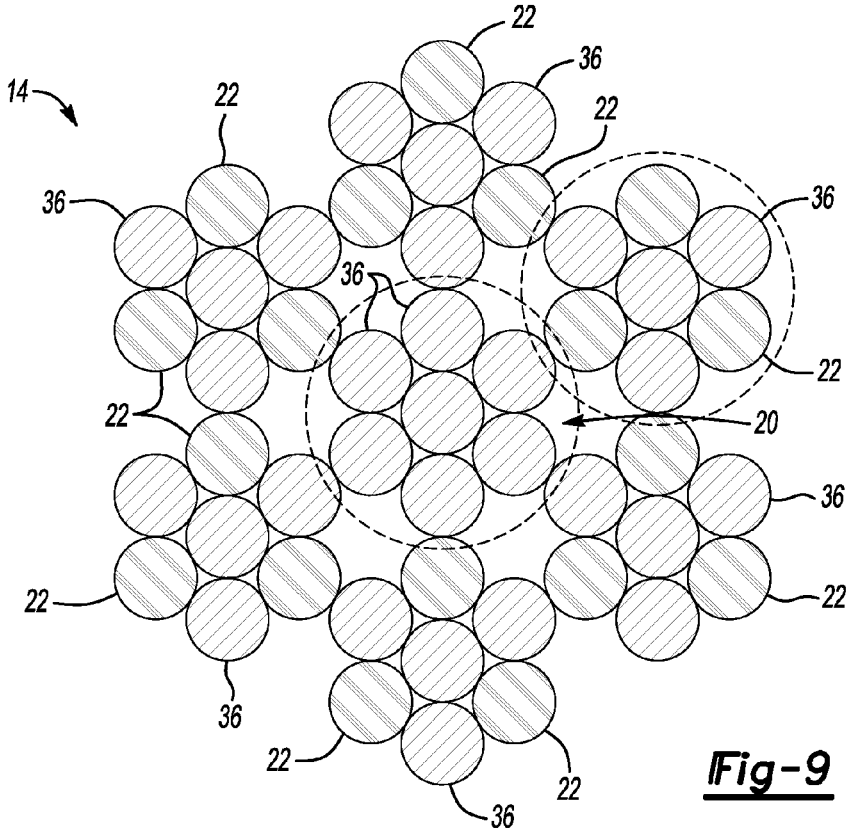
FIG. 9 is a schematic illustration of a cross-sectional view of one embodiment of the cable of FIG. 1 taken along section line 9-9.
Figure 10A:
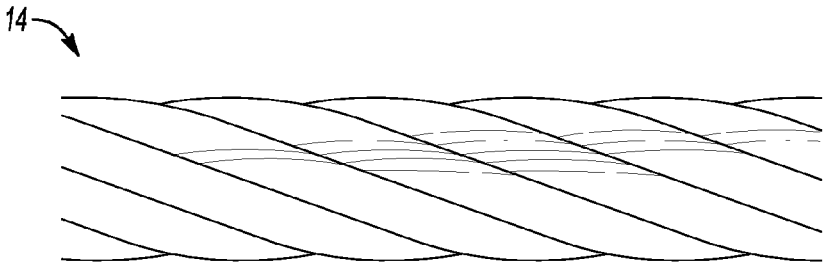
FIG. 10A is a schematic illustration of an elevational view of a portion of the cable of FIG. 1 having an outer helix configuration defining an outer right regular lay.
Figure 10B:
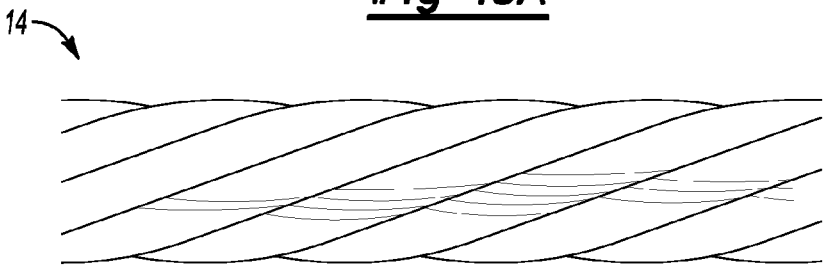
FIG. 10B is a schematic illustration of an elevational view of a portion of the cable of FIG. 1 having an outer helix configuration defining an outer left regular lay.
Figure 10C:
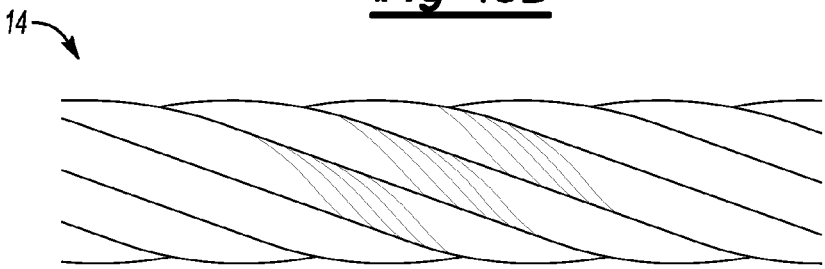
FIG. 10C is a schematic illustration of an elevational view of a portion of the cable of FIG. 1 having an outer helix configuration defining an outer right lang lay.
Figure 10D:
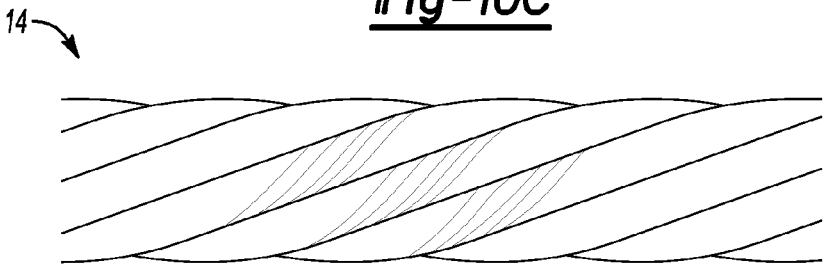
FIG. 10D is a schematic illustration of an elevational view of a portion of the cable of FIG. 1 having an outer helix configuration defining an outer left lang lay.
Figure 10E:
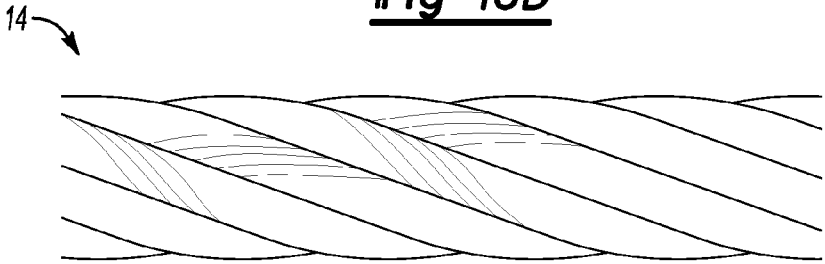
FIG. 10E is a schematic illustration of an elevational view of a portion of the cable of FIG. 1 having an outer helix configuration defining an outer right alternate lay.
Figure 11:
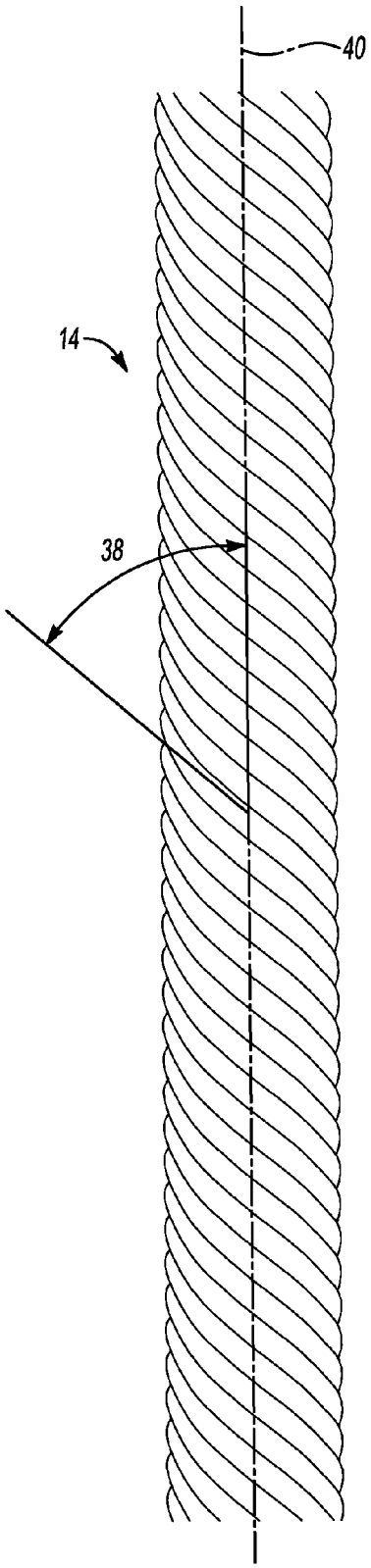
FIG. 11 is a schematic illustration of an elevational view of a portion of the cable of FIG. 1 having an outer helix configuration defining a helix angle.

Turning now to the structural configuration of the cable 14 as described with reference to FIGS. 8-10E, various lays and cross-sectional forms are exemplarily depicted in the illustrated embodiments. FIGS. 8 and 9 show an exemplary cable 14 wherein the plurality of wires 22 are helically wound about a core 20, so as to form a plurality of strands 24. The core 20 may support the wires 22 and the strands 24 into a nominally circular cross-section, as best shown in FIG. 9. The plurality of strands 24 may then be helically wound about another axial strand 24 that serves as the core 20 (FIGS. 8 and 9). It is to be appreciated that the helical strands 24 may be the major load bearing elements of the cable 14.

With continued reference to FIG. 8, the core 20 may lie along the central longitudinal axis 40 of the cable 14. The core 20 may be formed of a suitably flexible and compressible material that, among other things, enables the cable 14 to achieve a minimum spooling radius and presents strain compatibility. For example, the core 20 may be formed of rubber, foam, aluminum, copper, plastic, cotton, shape memory alloy in either the martensitic or austenitic phase, or combinations of these and other similar materials.

The core 20 may further present a heating and/or cooling element (not shown) configured to actuate or dissipate heat from the strands 24 or wires 22 of the cable 14. In this configuration, the core 20 may be formed of a thermally-conductive material and may be thermally coupled to a source (not shown), such as a thermoelectric element. Where Joule heating is to occur, the core 20 may be selected, in cooperation with a voltage range of the source, to provide a desired resistance that promotes power efficiency, and, for example, may comprise at least one Nichrome wire. Alternatively, the core 20 may present a flexible conduit that defines an internal space (not shown) that is fluidly coupled to a heated or cooling fluid (not shown).

Figure 4:
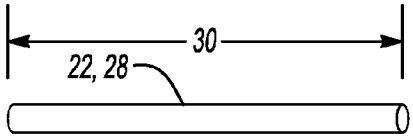
FIG. 4 is a schematic illustration of one of a plurality of wires of the cable of FIGS. 1 and 2, wherein the wire has a first temperature-dependent state.
Figure 5:
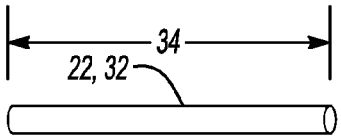
FIG. 5 is a schematic illustration of the wire of FIG. 4, wherein the wire has a second temperature-dependent state.

Referring now to FIGS. 4 and 5, each of the plurality of wires 22 is formed from a shape memory alloy transitionable in response to an activation signal 26 (FIG. 5) between a first temperature-dependent state 28 (FIG. 4) wherein each of the plurality of wires 22 has a first temperature-dependent length 30 (FIG. 4), and a second temperature-dependent state 32 (FIG. 5) wherein each of the plurality of wires 22 has a second temperature-dependent length 34 (FIG. 5) that is less than the first temperature-dependent length 30. That is, as set forth in more detail below, as the shape memory alloy is exposed to the activation signal 26, e.g., heat, each of the plurality of wires 22 may shorten or constrict in length as the shape memory alloy transitions from the first temperature-dependent state 28 to the second temperature-dependent state 32.

As used herein, the terminology "shape memory alloy" generally refers to a group of metallic materials that demonstrate the ability to return to some previously-defined shape or size when subjected to an appropriate thermal stimulus. Shape memory alloys are capable of undergoing phase transitions in which their yield strength, stiffness, dimension, and/or shape are altered as a function of temperature. The term "yield strength" refers to the stress at which a material exhibits a specified deviation from proportionality of stress and strain. Generally, in the low temperature, or martensite (diffusionless) phase, i.e., the first temperature-dependent state 28, shape memory alloys exist in a low symmetry monoclinic B19' structure with twelve energetically equivalent lattice correspondence variants that can be pseudo-plastically deformed. Upon exposure to some higher temperature, shape memory alloys will transform to an austenite or parent phase, i.e., the second temperature-dependent state 32, which has a B2 (cubic) crystal structure. Transformation returns the shape memory alloy to its shape prior to the deformation. Materials that exhibit this shape memory effect only upon heating are referred to as having one-way shape memory. Those materials that also exhibit shape memory upon re-cooling are referred to as having two-way shape memory behavior.

With continued reference to FIGS. 4 and 5, shape memory alloys may exist in several different temperature-dependent phases or states 28, 32. The most commonly utilized of these phases are the so-called martensite and austenite phases or states 28, 32 discussed above. In the following discussion, the martensite phase or first temperature-dependent state 28 (FIG. 4) generally refers to the more deformable, lower temperature phase, whereas the austenite phase or second temperature-dependent state 32 (FIG. 5) generally refers to the more rigid, higher temperature phase. When the shape memory alloy is in the martensite phase or first temperature-dependent state 28 and is heated, it begins to change into the austenite phase or second temperature-dependent state 32. The temperature at which this phenomenon starts is often referred to as austenite start temperature ($A_s$). The temperature at which this phenomenon is complete is called the austenite finish temperature ($A_f$).

When the shape memory alloy is in the austenite phase or second temperature-dependent state 32 (FIG. 5) and is cooled, it begins to change into the martensite phase or first temperature-dependent state 28 (FIG. 4), and the temperature at which this phenomenon starts is referred to as the martensite start temperature ($M_s$). The temperature at which austenite finishes transforming to martensite is called the martensite finish temperature ($M_f$). Generally, the shape memory alloys are softer and more easily deformable in their martensitic phase or first temperature-dependent state 28 and are harder, stiffer, and/or more rigid in the austenitic phase or second temperature-dependent state 32. In view of the foregoing, a suitable activation signal 26 (FIG. 5) for use with shape memory alloys is a thermal activation signal having a magnitude to cause transformations between the martensite and austenite phases, i.e., the first and second temperature-dependent states 28, 32, respectively.

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory alloy will induce the martensite-to-austenite type transition, and the alloy will recover the original, annealed shape. Hence, one-way shape memory effects are only observed upon heating. Active materials comprising shape memory alloy compositions that exhibit one-way memory effects do not automatically reform, and often require an external mechanical force to reset the device. As used herein the term "active material" refers to any material or composition that exhibits a reversible change in a fundamental (e.g., chemical or intrinsic physical) property, when exposed to or occluded from the activation signal 26. Suitable active materials include, but are not limited to, shape memory materials (e.g., shape memory alloys), ferromagnetic shape memory alloys, and electro-active polymers, etc.). It is appreciated that these types of active materials have the ability to rapidly displace, or remember their original shape and/or elastic modulus, which can subsequently be recalled by applying an external stimulus. As such, deformation from the original shape is a temporary condition.

Intrinsic and extrinsic two-way shape memory alloys are characterized by a shape transition both upon heating from the martensite phase or first temperature-dependent state 28 (FIG. 4) to the austenite phase or second temperature-dependent state 32 (FIG. 5), as well as an additional shape transition upon cooling from the austenite phase or second temperature-dependent state 32 back to the martensite phase or first temperature-dependent state 28. Active materials that exhibit an intrinsic shape memory effect are fabricated from a shape memory alloy composition that will cause the shape memory alloy to automatically reform itself as a result of the above-noted phase transformations. Intrinsic two-way shape memory behavior must be induced in the shape memory alloy through processing. Such procedures include extreme deformation of the alloy while in the martensite phase or first temperature-dependent state 28, heating-cooling under constraint or load, or surface modification such as laser annealing, polishing, or shot-peening. Once the shape memory alloy has been trained to exhibit the two-way shape memory effect, the shape change between the low- and high-temperature states 28, 32 is generally reversible and persists through a high number of thermal cycles. In contrast, shape memory alloys that exhibit the extrinsic two-way shape memory effects are composite or multi-component materials that combine a shape memory alloy composition that exhibits a one-way effect with another element that provides a restoring force to reform an original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, and typically provide the system with shape memory effects, superelastic effects, and high damping capacity.

Suitable shape memory alloys include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the shape memory alloy composition exhibits a shape memory effect, e.g., change in shape orientation, damping capacity, and the like.

It is to be appreciated that shape memory alloys may exhibit a modulus increase of 2.5 times and a dimensional change, i.e., a recovery of pseudo-plastic deformation induced when in the martensitic phase or first temperature-dependent state 28 (FIG. 4), of up to 8% depending on the amount of pre-strain when heated above their martensite-to-austenite phase transition temperature. It is to be appreciated that thermally-induced shape memory alloy phase changes are one-way so that a biasing force return mechanism (such as a spring) would be required to return the shape memory alloy to its starting configuration once the applied field is removed. Joule heating can be used to make the entire system electronically controllable.

Stress-induced phase changes in shape memory alloys, caused by loading and unloading of shape memory alloys (when at temperatures above $A_f$), are two-way by nature. That is to say, application of sufficient stress when a shape memory alloy is in its austenitic phase or second temperature-dependent state 32 (FIG. 5) will cause the shape memory alloy to change to its lower modulus martensitic phase or first temperature-dependent state 28 (FIG. 4) in which it can exhibit up to 8% of "superelastic" deformation. Removal of the applied stress will cause the shape memory alloy to switch back to its austenitic phase or second temperature-dependent state 32, and in so doing, recover its starting shape and higher modulus.

Ferromagnetic shape memory alloys (FSMA) are a subclass of shape memory alloy. These materials behave like conventional shape memory alloys that have a stress- or thermally-induced phase transformation between martensite and austenite. Additionally, ferromagnetic shape memory alloys are ferromagnetic and have strong magnetocrystalline anisotropy, which permit an external magnetic field to influence the orientation/fraction of field-aligned martensitic variants. When the magnetic field is removed, the ferromagnetic shape memory alloy may exhibit complete two-way, partial two-way, or one-way shape memory. For partial two-way or one-way shape memory, an external stimulus, temperature, magnetic field or stress may permit the ferromagnetic shape memory alloy to return to its starting state. Perfect two-way shape memory may be used for proportional control with continuous power supplied. External magnetic fields are generally produced via soft-magnetic core electromagnets in automotive applications, though a pair of Helmholtz coils may also be used for fast response.

Referring now to FIG. 9, the cable 14 may also include, in addition to the plurality of wires 22, a plurality of lines 36 formed from a non-shape memory alloy material. The plurality of lines 36 may be included to provide increased structural integrity, act as a return spring, or otherwise tailor the performance of the cable 14. With respect to structural integrity, it is to be appreciated that the plurality of wires 22 and strands 24 generally support tensile loads in parallel, so as to provide redundancy.

With continued reference to FIG. 9, the diameters of the plurality of wires 22 may be congruent or variable, but are cooperatively configured to generate a required lifting force. The plurality of wires 22 may be preformed by plastic deformation into a helical reference configuration consistent with a desired geometry to avoid formation of burrs. The plurality of wires 22 may present non-helical permanent shapes, so that upon activation of the shape memory alloy, the cable 14 may exhibit linear and/or rotational displacement as the shape memory alloy transitions between the first temperature-dependent state 28 (FIG. 4) and the second temperature-dependent state 32 (FIG. 5), as set forth in more detail below.

More particularly, in the cable configurations shown in FIGS. 8-11, each wire 22 (FIG. 8) in a strand 24 (FIG. 8) may present congruent helices defining a helix angle 38 (FIG. 11) and direction of lay. It is again noted, however, that the present disclosure may encompass other geometric forms such as straight bundles, braids, woven ropes, etc. The helices of the wires 22 in a strand 24 versus that of the strands 24 in a given layer can be laid in an opposite sense (i.e., regular lay) or in the same sense (i.e., lang lay), which affects the helix angle 38 the wires 22 make with the central longitudinal axis 40 (FIG. 8) of the cable 14. As shown in FIGS. 10A-E, for example, the outer wire 22/strand 24 helix configurations may present a right regular (FIG. 10A), left regular (FIG. 10B), right lang (FIG. 10C), left lang (FIG. 10D), or right alternate (FIG. 10E) lay. It is to be appreciated that the helix angle 38 and lay may help determine the axial stiffness, stored elastic energy, bending/twisting compliance, exterior smoothness, abrasion resistance, and redundancy of the cable 14. For example, it is to be appreciated that the helix angle 38 is inversely proportional to a yield strength of the cable 14.

Referring again to FIGS. 1 and 2, the cable protection system 10 also includes a plurality of rails 42, e.g., two rails 42, translatable between a first position 44 (FIG. 1) wherein each of the plurality of rails 42 is disposed adjacent to and in contact with the cable 14, and a second position 46 (FIG. 2) wherein each of the plurality of rails 42 is spaced apart from the cable 14.

For example, referring to FIG. 1, the cable 14 may have a fixed end 48 and a distal end 50 spaced opposite the fixed end 48, and may further include a sheath 52 attached to the distal end 50. The sheath 52 may include a constraining pin 54 extending therefrom. Therefore, when the plurality of rails 42 are disposed in the first position 44, each of the plurality of rails 42 may prevent rotation of the constraining pin 54 and cable 14 about the central longitudinal axis 40. That is, the constraining pin 54 and cable 14 may not rotate about the central longitudinal axis 40 when the plurality of rails 42 are disposed adjacent to and in contact with the cable 14 and sheath 52.

Referring now to FIG. 2, when the plurality of rails 42 are disposed in the second position 46, each of the plurality of rails 42 may allow rotation of the constraining pin 54 and cable 14 about the central longitudinal axis 40 of the cable 14. That is, the constraining pin 54 and cable 14 may rotate about the central longitudinal axis 40, e.g., in the direction of arrow 96, when the plurality of rails are spaced apart from the cable 14 and sheath 52.

Referring again to FIGS. 1 and 2, each of the plurality of wires 22 may be twisted around the central longitudinal axis 40 into a first twisted configuration 56. The cable 14 may have a first stiffness (shown generally in FIG. 1) when the shape memory alloy has the first temperature-dependent state 28 (FIG. 4). In addition, as set forth in more detail below, the first twisted configuration 56 may correspond to a condition wherein the cable 14 is subject to the initial stress 58 (FIG. 1). Conversely, as best shown in FIG. 2, each of the plurality of wires 22 may be slackened about the central longitudinal axis 40 into a second twisted configuration 60 when the shape memory alloy has the second temperature-dependent state 32 (FIG. 5). As such, the cable 14 may have a second stiffness (shown generally in FIG. 2) that is less than the first stiffness when the shape memory alloy has the second temperature-dependent state 32. That is, each of the plurality of wires 22 may at least partially untwist about the central longitudinal axis 40 as the shape memory alloy transitions from the first temperature-dependent state 28 to the second temperature-dependent state 32.

Therefore, as set forth in more detail below, each of the plurality of wires 22 may be at least partially untwistable with respect to the central longitudinal axis 40 such that the cable 14 is transitionable from a first length 64 (FIG. 1) to a second length 66 (FIG. 2) that is greater than the first length 64 as each of the plurality of wires 22 elongates from the second temperature-dependent length 34 (FIG. 5).

Referring now to FIG. 3, in conjunction with the cable protection system 10 of FIGS. 1 and 2, the method 12 of reducing the initial stress 58 of the cable 14 is set forth herein.

As best described with reference to FIG. 1, the method 12 (FIG. 3) includes stretching 68 (FIG. 3) the cable 14 to the first length 64 in response to the force 18 generated by the load 16 to thereby define the initial stress 58 on the cable 14. The cable 14 has the central longitudinal axis 40, and includes the plurality of wires 22 each twisted around the central longitudinal axis 40 and formed from the shape memory alloy, as set forth above. More specifically, the cable 14 may be attached to the load 16 and may begin to lift, translate, or move the load 16 in a direction denoted generally by arrow 70. As the cable 14 begins to lift the load 16, the force 18 generated by the load 16 stretches the cable 14 so that the cable 14 may snug down upon itself, and the cable 14 may lengthen to the first length 64. That is, the plurality of wires 22 may snug down upon the central longitudinal axis 40 in the direction of arrow 72 (FIG. 1), and the cable 14 may stretch such that the cable 14 has the first stiffness and is subjected to the initial stress 58. The first length 64 and initial stress 58 may correspond to a limit of the cable 14 such that the cable 14 is not overloaded, overstressed, or overstretched. That is, the first length 64 and initial stress 58 may correspond to a condition wherein the cable operates efficiently to begin to lift the load 16 and, for example, does not fray, warp, bend, and/or break.

Referring again to FIG. 3, after stretching 68, the method 12 also includes activating 74 the shape memory alloy by exposing the shape memory alloy to the activation signal 26 (FIG. 2) such that the shape memory alloy transitions from the first temperature-dependent state 28 (FIG. 4) to the second temperature-dependent state 32 (FIG. 5). For example, activating 74 may include exposing the shape memory alloy to heat, as set forth above, so that the shape memory alloy transitions from the first temperature-dependent state 28 wherein each of the plurality of wires 22 has the first temperature-dependent length 30 (FIG. 4), to the second temperature-dependent state 32 wherein each of the plurality of wires 22 has the second temperature-dependent length 34 (FIG. 5).

Referring again to FIG. 1, the method 12 (FIG. 3) may also include, prior to activating 74 (FIG. 3), retaining 76 the cable 14 in the first twisted configuration 56. For example, retaining 76 may include constraining the cable 14 between the plurality of rails 42 disposed adjacent to the cable 14. More specifically, retaining 76 may include constraining the constraining pin 54 between the plurality of rails 42 disposed adjacent to the cable 14 so that the cable 14 cannot rotate about the central longitudinal axis 40.

Referring again to FIG. 3, the method 12 may include, concurrent to activating 74, modifying 78 the first stiffness (shown generally in FIG. 1) to the second stiffness (shown generally in FIG. 2) that is less than the first stiffness. That is, modifying 78 may include decreasing the first stiffness of the cable 14. In particular, concurrently activating 74 and modifying 78 may include partially untwisting the plurality of wires 22 with respect to the central longitudinal axis 40 of the cable 14.

Referring now to FIG. 2, the method 12 (FIG. 3) further includes, concurrent to activating 74 (FIG. 3), elongating 80 (FIG. 3) the cable 14 to the second length 66 that is greater than the first length 64 (FIG. 1) in response to the force 18 to define a second stress 62 on the cable 14 that is less than the initial stress 58 (FIG. 1) and thereby reduce the initial stress 58 on the cable. That is, elongating 80 may protect the cable 14 from overstretching due to overstress of the cable 14, i.e., stressing the cable 14 beyond the initial stress 58. More specifically, elongating 80 may include lengthening each of the plurality of wires 22 from the second temperature-dependent length 34 (FIG. 5).

For example, referring again to FIG. 2, elongating 80 may include translating the plurality of rails 42 away from the cable 14 to thereby unconstrain the cable 14 and reduce the initial stress 58 (FIG. 1) to the second stress 62. That is, translating the plurality of rails 42 away from the cable 14 may allow the cable 14 to rotate about the central longitudinal axis 40, e.g., in the direction of arrow 96. Therefore, upon concurrent activating 74 (FIG. 3) and elongating 80 (FIG. 3), the plurality of wires 22 may at least partially untwist from the central longitudinal axis 40. That is, the plurality of wires 22 may be slackened about the central longitudinal axis 40 into the second twisted configuration 60, e.g., such that the cable 14 has the second stiffness when the shape memory alloy has the second temperature-dependent state 32 (FIG. 5). Further, as set forth in more detail below, the second twisted configuration 60 may correspond to a condition wherein the cable 14 is subject to the second stress 62 (FIG. 2).

More specifically, as the shape memory alloy is activated by the activation signal 26, the shape memory alloy may attempt to revert or transition from the first temperature-dependent state 28 (FIG. 4) to the second temperature-dependent state 32 (FIG. 5). Stated differently, each of the plurality of wires 22 may attempt to shorten from the first temperature-dependent length 30 (FIG. 4) to the second temperature-dependent length 34 (FIG. 5) as a temperature of the shape memory alloy increases. Generally, without the protection provided by the cable protection system 10 and method 12, since the plurality of wires 22 would otherwise be physically constrained by one another as the cable 14 snugs down upon itself, such attempt at shortening may strain the plurality of wires 22, increase the stress on the cable 14 to a quantity greater than the initial stress 58, and damage the cable 14.

Figure 6:
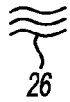
FIG. 6 is a schematic illustration of the cable of FIGS. 1 and 2 disposed in a first twisted configuration.
Figure 6:
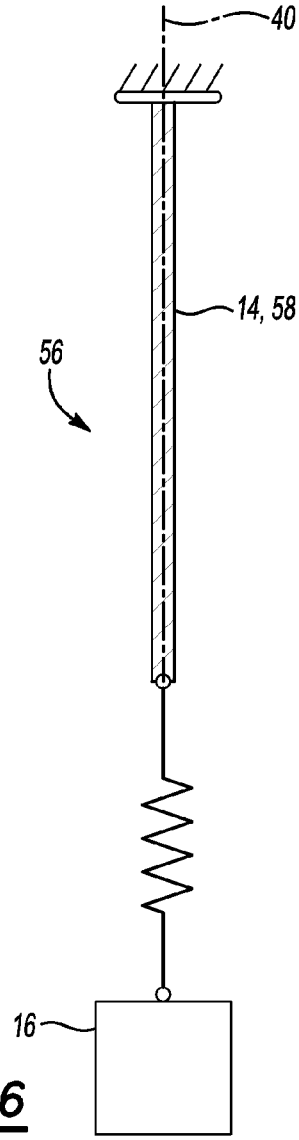
Figure 7:
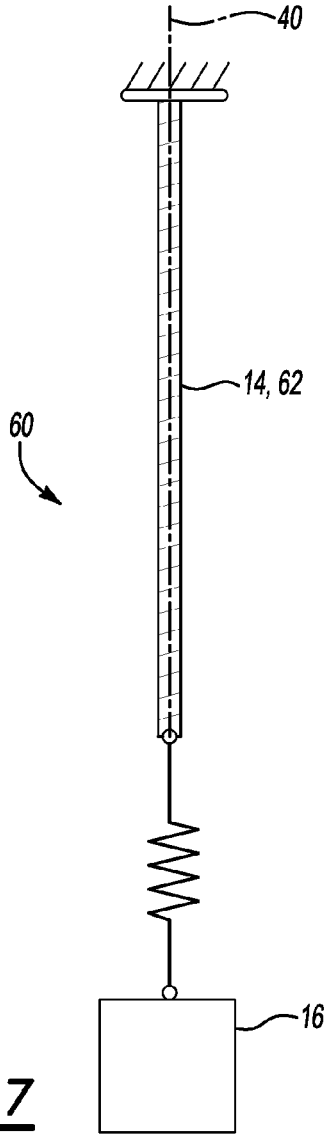
FIG. 7 is a schematic illustration of the cable of FIG. 6 disposed in a second twisted configuration.

However, as best shown in FIGS. 6 and 7, the method 12 (FIG. 3) may include allowing the cable 14 to at least partially untwist to thereby provide each of the plurality of wires 22 space or room to reconfigure, i.e., lengthen and elongate, along the central longitudinal axis 40 (FIG. 2). Such reconfiguration from the first twisted configuration 56 (FIG. 6) to the second twisted configuration 60 (FIG. 6) may reduce the strain of each wire 22 and thereby decrease the initial stress 58 (FIG. 1) and first stiffness of the cable 14 to the second stress 62 (FIG. 7) and second stiffness, respectively. Stated differently, concurrently activating 74 and elongating 80 may include partially untwisting the plurality of wires 22 with respect to the central longitudinal axis 40 from the first twisted configuration 56 to the second twisted configuration 60. That is, concurrently activating 74 (FIG. 3) the shape memory alloy and elongating 80 (FIG. 3) the cable 14 may alleviate or reduce the initial stress 58 on the cable 14 and allow the cable 14 to continue to lift, translate, or move the load 16 without overstressing and/or overstretching. As such, concurrent activation of the shape memory alloy and elongation of the cable 14 to thereby reduce the initial stress 58 to the second stress 62 may prevent damage to and overloading of the cable 14, and may modify the first stiffness to the second stiffness.

Figure 12:
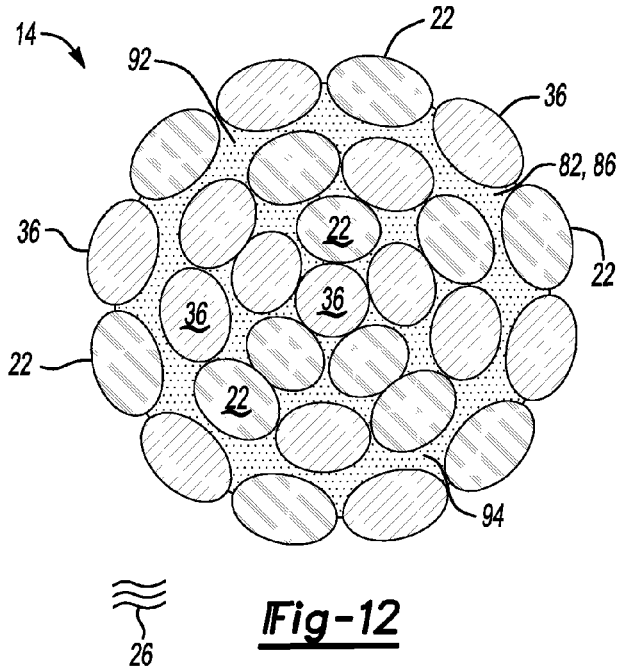
FIG. 12 is a schematic illustration of a cross-sectional view of another embodiment of the cable of FIG. 1 taken along section lines 9-9.
Figure 13:
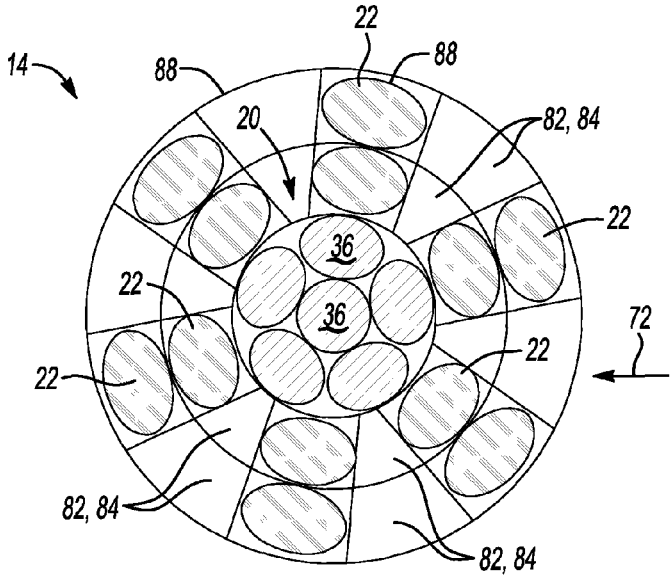
FIG. 13 is a schematic illustration of a cross-sectional view of yet another embodiment of the cable of FIG. 1 taken along section lines 9-9.

Referring now to FIGS. 12 and 13, in one non-limiting embodiment, the cable 14 may further include an inter-wire element 82 longitudinally engaged with and disposed adjacent to the plurality of wires 22. For example, the inter-wire element 82 may extend along the central longitudinal axis 40 (FIG. 1) along an entirety of the cable 14, or may be disposed along select longitudinal portions (not shown) of the cable 14. As set forth in more detail below, the inter-wire element 82 is operable to modify interaction between the plurality of wires 22.

With continued reference to FIGS. 12 and 13, as non-limiting examples, the inter-wire element 82 may be a wire surface condition (e.g., texturing), one or more spacers 84 (FIG. 13), a lubricant 86 (FIG. 12), a cover 88 (FIG. 13), or a wire coating, e.g., carbon nanotubes as fins (not shown), that promotes actuation, facilitates performance, protects the interstitial cable components, or otherwise extends an operating life of the cable 14, as set forth in more detail below.

Referring again to the method 12 (FIG. 3), for the embodiment wherein the cable 14 includes the inter-wire element 82 (FIGS. 12 and 13), the method 12 includes, concurrent to activating 74 (FIG. 3), contacting 90 (FIG. 3) at least one of the plurality of wires 22 and the inter-wire element 82. That is, concurrently activating 74 and contacting 90 may include partially untwisting the plurality of wires 22 with respect to the central longitudinal axis 40 (FIG. 2) of the cable 14, and may thereby modify 78 (FIG. 3) the first stiffness (shown generally in FIG. 1) to the second stiffness (shown generally in FIG. 2) that is less than the first stiffness, and consequently reduce the initial stress 58 (FIG. 1) to the second stress 62 (FIG. 2).

Referring again to FIG. 13, in one example, the inter-wire element 82 may include the one or more spacers 84 and may be attached to the core 20 and/or the plurality of wires 22 to aid or hinder heating or cooling by modifying or preventing wire interaction. For example, the spacer 84 may be formed from a resilient material, such as a rubber or an elastomer. Further, a thickness and/or stiffness of the spacer 84 may be selected to prevent the cable 14 from exceeding a predetermined strain level.

More specifically, as best shown in FIG. 13, the one or more spacers 84 may be disposed between adjacent ones of the plurality of wires 22, and contacting 90 (FIG. 3) may include spreading adjacent ones of the plurality of wires 22 apart from one another. For example, contacting 90 may include resisting compression of each of the plurality of wires 22 in a direction (denoted generally by arrow 72 in FIG. 13) perpendicular to the central longitudinal axis 40 (FIG. 1) of the cable 14. That is, as the shape memory alloy transitions from the first temperature-dependent state 28 (FIG. 4) to the second temperature-dependent state 32 (FIG. 5), each of the plurality of wires 22 may attempt to shorten from the first temperature-dependent length 30 (FIG. 4) to the second temperature-dependent length 34 (FIG. 5) and thereby begin to compress against the central longitudinal axis 40.

However, with continued reference to FIG. 13, the one or more spacers 84 may prevent compression of the plurality of wires 22 against the core 20 or central longitudinal axis 40 and may instead allow the plurality of wires 22 to remain spaced apart from one another so as to allow at least a partial untwisting of the cable 14 to the second twisted configuration 60 (FIG. 2). Stated differently, as the plurality of wires 22 squeeze down upon the spacer 84, the spacer 84 may resist the compression and spread the plurality of wires 22 apart from one another to reduce or relieve the initial stress 58 on the cable 14.

For the method 12 (FIG. 3), in another non-limiting example, contacting 90 (FIG. 3) may include reducing a coefficient of friction between adjacent ones of the plurality of wires 22 to thereby reduce the initial stress 58 (FIG. 1) to the second stress 62 (FIG. 2). For example, as described with reference to FIG. 12, the inter-wire element 82 may include the lubricant 86 disposed between adjacent ones of the plurality of wires 22. The lubricant 86 may be, for example, petroleum jelly that is operable to reduce the coefficient of friction between adjacent ones of the plurality of wires 22. Where individual strands 24 (FIG. 8) and/or wires 22 are to be separately activated, the lubricant 86 may be thermally- and/or electrically-insulating. Conversely, to enable more uniform actuation from a single strand 24 or wire 22, the lubricant 86 may be thermally- and/or electrically-conducting.

As such, for the method 12 (FIG. 3), contacting 90 (FIG. 3) may include longitudinally sliding adjacent ones of the plurality of wires 22 with respect to one another to thereby partially untwist the plurality of wires 22 with respect to the central longitudinal axis 40 (FIG. 1). That is, the lubricant 86 (FIG. 12) may reduce the coefficient of friction between individual ones of the plurality of wires 22. As the force 18 (FIG. 1) generated by the load 16 (FIG. 1) is applied to the cable 14, the lubricant 86 may allow longitudinal sliding of the plurality of wires 22 with respect to one another. As such, the plurality of wires 22 may reconfigure from the first twisted configuration 56 (FIG. 1) to the second twisted configuration 60 (FIG. 2) and thereby lengthen the cable 14 to at least the second length 66 (FIG. 2) to thereby reduce or relieve the initial stress 58 on the cable 14. That is, the lubricant 86 may help each of the plurality of wires 22 align longitudinally along the central longitudinal axis 40.

With continued reference to FIG. 12, in addition to or in lieu of the lubricant 86, the plurality of wires 22 may be coated, covered, or treated, so as to present a desired surface condition. For example, the cover 88 may be applied to each of the plurality of wires 22 to modify fatigue/thermo-mechanical interface properties of each wire 22. Moreover, the cover 88 may be configured to modify the coefficient of friction between adjacent ones of the plurality of wires 22. It is to be appreciated that the cover 88, e.g., Teflon™ 66, may be used to coat individual strands 24 or wires 22. Further, the response of the cable 14 may be tailored by modifying the frictional contribution from strand 24/wire 22 to strand 24/wire 22. In addition, the coating or cover 88 may be used to modify emissivity or heat transfer properties of each of the plurality of wires 22. Lastly, it is appreciated that a light- or electromagnetic field-sensitive coating may be used in conjunction with a suitable, e.g., fiber optic, core 20, such that the passage of light or other medium causes the coating to generate heat energy.

Referring again to FIG. 12, in another non-limiting example, the inter-wire element 82 may change phase in response to the activation signal 26 (FIG. 2) between a first phase 92 having a first flexibility and a second phase 94 having a second flexibility that is greater than the first flexibility. That is, the inter-wire element 82 may become more flexible upon exposure to the activation signal 26. For example, the inter-wire element 82 may be formed from a wax that may change from a solid, i.e., the first phase 92, to a liquid, i.e., the second phase 94, upon exposure to the activation signal 26, e.g., heat. Alternatively or additionally, the inter-wire element 82 may be an active material, such as a shape memory polymer, that may decrease in flexibility from the first flexibility to the second flexibility by from about 100% to about 400%.

Therefore, in operation, as best described with reference to FIGS. 4 and 5, concurrently activating 74 (FIG. 3) and contacting 90 (FIG. 3) may include partially untwisting the plurality of wires 22 with respect to the central longitudinal axis 40 (FIG. 1) of the cable 14. That is, the plurality of wires 22 may reconfigure from the first twisted configuration 56 (FIG. 1) to the second twisted configuration 60 (FIG. 2) and thereby lengthen the cable 14 to at least the second length 66 (FIG. 2) to reduce the initial stress 58 on the cable 14 to the second stress 62.

More specifically, as the shape memory alloy of each of the plurality of wires 22 begins to transition from the first temperature-dependent state 28 (FIG. 4) to the second temperature-dependent state 32 (FIG. 5) and stress and strain on the cable 14 begins to increase, concurrently activating 74 (FIG. 3) the shape memory alloy and elongating 80 (FIG. 3) the cable 14 to the second length 66 (FIG. 2) allows the cable 14 to transition from the first twisted configuration 56 (FIGS. 1 and 6) to the second twisted configuration 60 (FIGS. 2 and 7), and allows the initial stress 58 (FIGS. 1 and 6) and first stiffness to relax to the second stress 62 (FIGS. 2 and 7) and second stiffness, respectively.

Therefore, as described with reference to FIGS. 1 and 2, the cable 14 may be operable to lift the load 16. That is, as the cable 14 begins to lift the load 16 so that the cable 14 is stretched along the central longitudinal axis 40, the shape memory alloy is activated, which may increase the temperature of the shape memory alloy and cause the shape memory alloy to attempt to revert to the second temperature-dependent state 32 (FIG. 5). That is, upon activation, the shape memory alloy may attempt to shorten from the first temperature-dependent length 30 (FIG. 4) to the second temperature-dependent length 34 (FIG. 5). Without the cable protection system 10 and method 12, the plurality of wires 22 may be increasingly constrained against one another as the cable 14 stretches in response to the load 16. Such conditions may increase stress and strain on the cable 14 and cause the cable 14 and/or any one of the plurality of wires 22 to fail to perform, e.g., to fray, warp, bend, and/or break. That is, such conditions may overload, overstress, and/or overstretch the cable 14.

However, the cable protection system 10 and method 12 reduce the initial stress 58 (FIG. 1) and minimize strain on the cable 14, and therefore protect the cable 14 from damage due to overloading, overstressing, and/or overstretching. In particular, concurrently activating 74 (FIG. 3) the shape memory alloy and elongating 80 (FIG. 3) the cable 14 to the second length 66 (FIG. 2), e.g., by at least partially untwisting from the first twisted configuration 56 (FIG. 1) to the second twisted configuration 60 (FIG. 2) to thereby modify the first stiffness to the second stiffness, protects the cable 14 from overstress and overstretching. Stated differently, the cable protection system 10 and method 12 may reduce the initial stress 58 to the second stress 62 and may relieve strain on the cable 14 by allowing each of the plurality of wires 22 to assume an elongated, longer, and straighter path along the central longitudinal axis 40 by at least partially untwisting the cable 14 from the first twisted configuration 56 to the second twisted configuration 60. That is, the cable protection system 10 and method 12 may align each of the plurality of wires 22 substantially parallel to the central longitudinal axis 40 of the cable 14 as the cable 14 elongates. As such, the cable protection system 10 and method 12 allow the cable 14 to physically reconfigure to a strain- and stress-reducing arrangement to thereby reduce the initial stress 58 on each of the plurality of wires 22.

While the best modes for carrying out the disclosure have been described in detail, those familiar with the art to which this disclosure relates will recognize various alternative designs and embodiments for practicing the disclosure within the scope of the appended claims.

The invention claimed is:

1. A method of reducing an initial stress on a cable, the method comprising:

stretching the cable to a first length in response to a force generated by a load to thereby define the initial stress on the cable, wherein the cable has a central longitudinal axis and includes:

a plurality of wires each twisted around the central longitudinal axis and formed from a shape memory alloy transitionable in response to an activation signal between a first temperature-dependent state wherein each of the plurality of wires has a first temperature-dependent length, and a second temperature-dependent state wherein each of the plurality of wires has a second temperature-dependent length that is less than the first temperature-dependent length;

after stretching, activating the shape memory alloy by exposing the shape memory alloy to the activation signal such that the shape memory alloy transitions from the first temperature-dependent state to the second temperature-dependent state; and concurrent to activating, elongating the cable to a second length that is greater than the first length in response to the force to define a second stress on the cable that is less than the initial stress and thereby reduce the initial stress on the cable.

2. The method of claim 1, wherein each of the plurality of wires is twisted around the central longitudinal axis into a first twisted configuration when the shape memory alloy has the first temperature-dependent state, and wherein each of the plurality of wires is slackened about the central longitudinal axis into a second twisted configuration when the shape memory alloy has the second temperature-dependent state, and further wherein concurrently activating and elongating includes partially untwisting the plurality of wires with respect to the central longitudinal axis from the first twisted configuration to the second twisted configuration.

3. The method of claim 2, further including, prior to activating, retaining the cable in the first twisted configuration.

4. The method of claim 3, wherein retaining includes constraining the cable between a plurality of rails disposed adjacent to the cable.

5. The method of claim 3, wherein the cable has a fixed end and a distal end spaced opposite the fixed end, and further includes a sheath attached to the distal end and including a constraining pin extending therefrom, and further wherein retaining includes constraining the constraining pin between the plurality of rails disposed adjacent to the cable.

6. The method of claim 4, wherein elongating includes translating the plurality of rails away from the cable to thereby unconstrain the cable and reduce the initial stress to the second stress.

7. The method of claim 1, wherein elongating includes lengthening each of the plurality of wires from the second temperature-dependent length.

8. A method of reducing an initial stress on a cable, the method comprising:

stretching the cable to a first length in response to a force generated by a load to thereby define the initial stress on the cable, wherein the cable has a central longitudinal axis and includes:

a plurality of wires each twisted around the central longitudinal axis and formed from a shape memory alloy transitionable in response to an activation signal between a first temperature-dependent state wherein each of the plurality of wires has a first temperature-dependent length, and a second temperature-dependent state wherein each of the plurality of wires has a second temperature-dependent length that is less than the first temperature-dependent length; and an inter-wire element longitudinally engaged with and disposed adjacent to the plurality of wires, wherein the inter-wire element is operable to modify interaction between the plurality of wires;

after stretching, activating the shape memory alloy by exposing the shape memory alloy to the activation signal such that the shape memory alloy transitions from the first temperature-dependent state to the second temperature-dependent state;

concurrent to activating, contacting at least one of the plurality of wires and the inter-wire element; and concurrent to contacting, elongating the cable to a second length that is greater than the first length in response to the force to define a second stress on the cable that is less than the initial stress and thereby reduce the initial stress on the cable.

9. The method of claim 8, wherein each of the plurality of wires is twisted around the central longitudinal axis into a first twisted configuration when the shape memory alloy has the first temperature-dependent state, and wherein each of the plurality of wires is slackened about the central longitudinal axis into a second twisted configuration when the shape memory alloy has the second temperature-dependent state, and further wherein concurrently activating and contacting includes partially untwisting the plurality of wires with respect to the central longitudinal axis from the first twisted configuration to the second twisted configuration.

10. The method of claim 8, wherein the inter-wire element includes one or more spacers disposed between adjacent ones of the plurality of wires, and further wherein contacting includes spreading adjacent ones of the plurality of wires apart from one another.

11. The method of claim 10, wherein contacting includes resisting compression of each of the plurality of wires in a direction perpendicular to a central longitudinal axis of the cable.

12. The method of claim 8, wherein contacting includes reducing a coefficient of friction between adjacent ones of the plurality of wires to thereby reduce the initial stress to the second stress.

13. The method of claim 12, wherein the inter-wire element includes a lubricant disposed between adjacent ones of the plurality of wires, and further wherein contacting includes longitudinally sliding adjacent ones of the plurality of wires with respect to one another to thereby partially untwist the plurality of wires with respect to the central longitudinal axis.

14. The method of claim 12, wherein the inter-wire element changes phase in response to the activation signal between a first phase having a first flexibility and a second phase having a second flexibility that is greater than the first flexibility, and further wherein concurrently activating and contacting includes partially untwisting the plurality of wires with respect to the central longitudinal axis.

15. A cable protection system comprising:

a cable having a central longitudinal axis and including:

a plurality of wires each twisted around the central longitudinal axis and formed from a shape memory alloy transitionable in response to an activation signal between a first temperature-dependent state wherein each of the plurality of wires has a first temperature-dependent length, and a second temperature-dependent state wherein each of the plurality of wires has a second temperature-dependent length that is less than the first temperature-dependent length; and a lubricant disposed between adjacent ones of the plurality of wires; and a plurality of rails translatable between a first position wherein each of the plurality of rails is disposed adjacent to and in contact with the cable, and a second position wherein each of the plurality of rails is spaced apart from the cable.

16. The cable protection system of claim 15, wherein the cable has a fixed end and a distal end spaced opposite the fixed end, and further includes a sheath attached to the distal end and including a constraining pin extending therefrom.

17. The cable protection system of claim 16, wherein each of the plurality of rails prevents rotation of the constraining pin and the cable about the central longitudinal axis when the plurality of rails are disposed in the first position.

18. The cable protection system of claim 16, wherein each of the plurality of rails allows rotation of the constraining pin and the cable about the central longitudinal axis when the plurality of rails are disposed in the second position.

19. The cable protection system of claim 15, wherein each of the plurality of wires is twisted around the central longitudinal axis into a first twisted configuration when the shape memory alloy has the first temperature-dependent state, and wherein each of the plurality of wires is slackened about the central longitudinal axis into a second twisted configuration when the shape memory alloy has the second temperature-dependent state to thereby at least partially untwist the plurality of wires about the central longitudinal axis as the shape memory alloy transitions from the first temperature-dependent state to the second temperature-dependent state.

20. The cable protection system of claim 15, wherein each of the plurality of wires is at least partially untwistable with respect to the central longitudinal axis such that the cable is transitionable from a first length to a second length that is greater than the first length as each of the plurality of wires elongates from the second temperature-dependent length.

* * * * *